US006777630B1

(12) United States Patent
Dove et al.

(10) Patent No.: US 6,777,630 B1
(45) Date of Patent: Aug. 17, 2004

(54) LIQUID METAL MICRO SWITCHES USING AS CHANNELS AND HEATER CAVITIES MATCHING PATTERNED THICK FILM DIELECTRIC LAYERS ON OPPOSING THIN CERAMIC PLATES

(75) Inventors: Lewis R Dove, Monument, CO (US); Paul Thomas Carson, Colorado Springs, CO (US); John F Casey, Colorado Springs, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/426,449

(22) Filed: Apr. 30, 2003

(51) Int. Cl.[7] ..... H01H 29/00

(52) U.S. Cl. ..... 200/182

(58) Field of Search ..... 200/182, 187–189, 200/209–210, 233–236; 310/328, 331, 348, 363; 335/4, 47, 78; 385/19

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | von Tomkewitsch et al. |

(List continued on next page.)

FOREIGN PATENT DOCUMENTS

| | | |
|---|---|---|
| CH | 47-21645 | 10/1972 |
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | 62-276838 | 12/1987 |
| JP | 63-294317 | 12/1988 |
| JP | 8-125487 | 5/1996 |
| JP | 9-161640 | 6/1997 |
| WO | WO99-46624 | 9/1999 |

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. 1B, p. 827.

Bhedwar, Homi C., et al. "Ceramic Multilayer Package Fabrication", Electronic Materials Handbook, Nov. 1989, pp 460–469, vol. 1 Packaging, Section 4: Packages.

Kim, Joonwon, et al., "A Micromechanical Switch With Electrostaticaly Driven Liquid–Metal Droplet", Sensors and Actuators, A; Physical v 9798, Apr. 1, 2002, 4 pages.

Simon, Jonathan, et al., "A Liquid–Filled Microrelay With A Moving Mercury Microdrop", Journal of Microelectromechanical Systems, Sep. 1997, pp 208–216, vol. 6, No. 3.

*Primary Examiner*—Michael A. Friedhofer
(74) *Attorney, Agent, or Firm*—Edward L. Miller

(57) ABSTRACT

An efficient way to fabricate the channels and cavities in a LIMMS device is to form them as matching upper and lower portions each created as a patterned layer of thick film dielectric material deposited on a respective upper or lower substrate. The two portions are adhered together by a patterned layer of adhesive, and hermetically sealed around an outer perimeter. The heater resistors are mounted atop the lower layer, thus suspending them away from that substrate and exposing more of their surface area. Vias can be used to route the conductors for the heaters and the switched signal contacts through the lower substrate to cooperate with surface mount techniques using solder balls on an array of contact pads. These vias can be made hermetic by their placement within the patterned layers of dielectric material and by covering their exposed ends with pads of hermetic metal. Suitable thick film dielectric materials that may be deposited as a paste and subsequently cured include the KQ 150 and KQ 115 thick film dielectrics from Heracus and the 4141A/D thick film compositions from DuPont.

14 Claims, 8 Drawing Sheets

U.S. PATENT DOCUMENTS 3,529,268 A 9/1970 Rauterberg
3,600,537 A 8/1971 Twyford
3,639,165 A 2/1972 Rairden, III
3,657,647 A 4/1972 Beusman et al.
3,955,059 A * 5/1976 Graf ..... 200/181
4,103,135 A 7/1978 Gomez et al.
4,158,118 A * 6/1979 Graf ..... 137/251.1
4,200,779 A 4/1980 Zakurdaev et al.
4,238,748 A 12/1980 Goullin et al.
4,245,886 A 1/1981 Kolodzey et al.
4,336,570 A 6/1982 Brower et al.
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 * 11/2001 Kondoh et al. ..... 200/182
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
6,647,165 B2 * 11/2003 Hu et al. ..... 385/16
2002/0037128 A1 3/2002 Burger et al.
2002/0146197 A1 10/2002 Yong
2002/0150323 A1 10/2002 Naoki et al.
2002/0168133 A1 11/2002 Saito
2003/0035611 A1 2/2003 Shi

* cited by examiner

LIQUID METAL MICRO SWITCHES USING AS CHANNELS AND HEATER CAVITIES MATCHING PATTERNED THICK FILM DIELECTRIC LAYERS ON OPPOSING THIN CERAMIC PLATES

BACKGROUND OF THE INVENTION

Recent developments have occurred in the field of very small switches having moving liquid metal-to-metal contacts and that are operated by an electrical impulse. That is, they are actually small latching relays that individually are SPST or SPDT, but which can be combined to form other switching topologies, such as DPDT. (Henceforth we shall, as is becoming customary, refer to such a switch as a Liquid Metal Micro Switch, or LIMMS.) With reference to FIGS. 1–4, we shall briefly sketch the general idea behind one class of these devices. Having done that, we shall advance to the topic that is most of interest to us, which is an improved technique for forming the needed channels and cavities of such switches fabricated on a substrate.

Refer now to FIG. 1A, which is a top sectional view of certain elements to be arranged within a cover block 1 of suitable material, such as glass. The cover block 1 has within it a closed-ended channel 7 in which there are two small movable distended droplets (12, 13) of a conductive liquid metal, such as mercury. The channel 7 is relatively small, and appears to the droplets of mercury to be a capillary, so that surface tension plays a large part in determining the behavior of the mercury. One of the droplets is long, and shorts across two adjacent electrical contacts extending into the channel, while the other droplet is short, touching only one electrical contact. There are also two cavities 5 and 6, within which are respective heaters 3 and 4, each of which is surrounded by a respective captive atmosphere (10, 11) of a suitable gas, such as $N_2$. Cavity 5 is coupled to the channel 7 by a small passage 8, opening into the channel 7 at a location about one third or one fourth the length of the channel from its end. A similar passage 9 likewise connects cavity 6 to the opposite end of the channel. The idea is that a temperature rise from one of the heaters causes the gas surrounding that heater to expand, which splits and moves a portion of the long mercury droplet, forcing the detached portion to join the short droplet. This forms a complementary physical configuration (or mirror image), with the large droplet now at the other end of the channel. This, in turn, toggles which two of the three electrical contacts are shorted together. After the change the heater is allowed to cool, but surface tension keeps the mercury droplets in their new places until the other heater heats up and drives a portion of the new long droplet back the other way. Since all this is quite small, it can all happen rather quickly; say, on the order of a millisecond, or less. The small size also lends itself for use amongst controlled impedance transmission line structures that are part of circuit assemblies that operate well into the microwave region.

To continue, then, refer now to FIG. 1B, which is a sectional side view of FIG. 1A, taken through the middle of the heaters 3 and 4. New elements in this view are the bottom substrate 2, which may be of a suitable ceramic material, such as that commonly used in the manufacturing of hybrid circuits having thin film, thick film or silicon die components. A layer 14 of sealing adhesive bonds the cover block 1 to the substrate 2, which also makes the cavities 5 and 6, passages 8 and 9, and the channel 7, each moderately gas tight (and also mercury proof, as well!). Layer 14 may be of a material called CYTOP (a registered trademark of Asahi Glass Co., and available from Bellex International Corp., of Wilmington, Del.). Also newly visible are vias 15–18 which, besides being gas tight, pass through the substrate 2 to afford electrical connections to the ends of the heaters 3 and 4. So, by applying a voltage between vias 15 and 16, heater 3 can be made to become very hot very quickly. That in turn, causes the region of gas 10 to expand through passage 8 and begin to force long mercury droplet 12 to separate, as is shown in FIG. 2. At this time, and also before heater 3 begins to heat, long mercury droplet 12 physically bridges and electrically connects contact vias 19 and 20, after the fashion shown in FIG. 1C. Contact via 21 is at this time in physical and electrical contact with the small mercury droplet 13, but because of the gap between droplets 12 and 13, is not electrically connected to via 20.

Refer now to FIG. 3A, and observe that the separation into two parts of what used to be long mercury droplet 12 has been accomplished by the heated gas 10, and that the right-hand portion (and major part of) the separated mercury has joined what used to be smaller droplet 13. Now droplet 13 is the larger droplet, and droplet 12 is the smaller. Referring to FIG. 3B, note that it is now contact vias 20 and 21 that are physically bridged by the mercury, and thus electrically connected to each other, while contact via 19 is now electrically isolated.

The LIMMS technique described above has a number of interesting characteristics, some of which we shall mention in passing. They make good latching relays, since surface tension holds the mercury droplets in place. They operate in all attitudes, and are reasonably resistant to shock. Their power consumption is modest, and they are small (less than a tenth of an inch on a side and perhaps only twenty or thirty thousandths of an inch high). They have decent isolation, are reasonably fast with minimal contact bounce. There are versions where a piezo-electrical element accomplishes the volume change, rather than a heated and expanding gas. There also exist certain refinements that are sometimes thought useful, such as bulges or constrictions in the channel or the passages. Those interested in such refinements are referred to the Patent literature, as there is ongoing work in those areas. See, for example, U.S. Pat. No. 6,323,447 B1.

To sum up our brief survey of the starting point in LIMMS technology that is presently of interest to us, refer now first to FIG. 4 and then to FIG. 5. In FIG. 4 there is shown an exploded view 32 of a slightly different arrangement of the parts, although the operation is just as described in connection with FIGS. 1–3. In particular, note that in this arrangement the heaters (3, 4) and their cavities (5, 6) are each on opposite sides of the channel 7. Another new element to note in FIG. 4 is the presence of contact electrodes 22, 23 and 24. These are (preferably thin film) depositions of metal that are electrically connected to the vias (19, 20 and 21, respectively). They not only serve to ensure good ohmic contact with the droplets of liquid metal, but they are also regions for the liquid metal to wet against, which provides some hysteresis in the pressures required to move the droplets. This helps ensure that the contraction caused by the cooling (and contraction) of the heated (and expanded) operating medium does not suck the droplet back toward where it just came from. The droplets of liquid metal are not shown in the figure.

If contact electrodes 22–24 are to be produced by a thin film process, then they will most likely need to be fabricated after any thick film layers of dielectric material are deposited on the substrate (as will occur in connection with many of the remaining figures). This order of operations is necessitated if the thick film materials to be deposited need high firing temperatures to become cured; those temperatures can easily be higher than what can be withstood by a layer of thin film metal. Also, if the layer of thin film metal is to depart from the surface of the substrate and climb the sides of a channel, then it might be helpful if the transition were not too abrupt.

FIG. 5 is a simplified exploded view 25 of a LIMMS device whose heater cavities, liquid metal channel and their interconnecting passages are formed in a layer of dielectric material between two substrates, instead of being recesses in a cover block. The figure shows a portion of a substrate 26, which may be of ceramic or glass, and which serves as a base upon which to fabricate the LIMMS device. Various metal conductors 27–31, which may be of gold, are deposited on the top surface of the substrate 26, or they may be what remains from a patterned removal of an entire metal sheet originally present on the surface of the substrate. The latter case cooperates nicely in instances where some of the conductors are to be co-planar transmission lines formed with the presence of a ground plane. Mercury amalgamates with gold, however, and if enough mercury is present, will dissolve it. It is therefore desirable to protect the gold with a covering of another metal, such as chromium or molybdenum. (Owing to the possibility of mercury smears during assembly, a complete over-covering of all the gold is more desirable than simply covering the exposed pads where the droplet or slug of mercury might be expected to touch the gold during normal operation.) In the figure, conductors 27 and 28 are drive lines for heater resistors 34 and 35, respectively. Conductors 29, 30 and 31 are switched signal lines that might also be parts of a controlled impedance transmission line structure.

Now note patterned layer 36. It is applied over the various conductors 27–31, and may be of KQ 150 or KQ 115 thick film dielectric material from Heraeus, or the 4141A/D thick film compositions from DuPont. These are materials that are applied as pastes and then cured under heat at prescribed temperatures for prescribed lengths of time. Depending upon the particular material, they may be applied as an undifferentiated sheet, cured and then patterned (say, by laser or chemical etching) or they may be patterned upon their initial application (via a screening process). In any event, the patterning produces the heater cavities 44 and 45, the liquid metal channel 46 and their interconnecting passages.

The conventional thick film processes used to print patterned layers of the dielectric material allows considerable control over the finished thickness of a cured layer of dielectric material (say, in the range of five to ten thousandths of an inch), and achieving sufficient uniformity of thickness is not a major difficulty. However, there are limits to how thin and how thick an uncured printed layer can be, and it may be necessary to apply (print) multiple layers to achieve a particular overall depth for layer 36. For the KQ material that is to be printed on using a fine mesh (screen) of stainless steel, a printed uncured layer is on the order of one to two thousandths of an inch in thickness. The KQ material shrinks in thickness by an amount of about thirty percent during the curing process. It is possible to print several uncured layers, one on top of the other, and then fire the whole works, or, the application sequence could be print—fire—print—fire . . . , or even print—print . . . print—fire—print—print . . . During the firing for curing the steep side walls and relatively sharp edges possible for the uncured printed layers become sloped and rounded, respectively. The resulting trapezoidal cross-sectional shape of the liquid metal channel 46 may be a significant influence in determining a desired thickness for layer 36. In this connection, the view shown in FIG. 5 is a considerable simplification, in that, for simplicity of the drawing, the heater cavities 44 and 45, liquid metal channel 46, and their interconnecting passages (not numbered in FIG. 5, but are shown as 8 and 9 in FIGS. 1 and 2) are all depicted as having steep side walls and sharp edges. It makes the basic subject matter of the drawing much easier to appreciate. When using printed KQ, however, the actual situation is much close to what is shown in FIGS. 6–9. Note the sloping side walls of the various patterned layers of dielectric material. Steep sidewalls and sharp edges are not necessarily bad, and can be obtained with other fabrication techniques, although that may also have an effect on the method used to create metalized regions, such as 41–43 that are to ascend such steep side walls.

Once layer 36 has been formed and patterned, metallic regions 41–43 are deposited. These correspond to metallic contacts 22–24 of FIG. 4, and serve to improve electrical contact with the liquid metal and to provide a surface that can be wetted by the liquid metal (for latching). Regions 41–43 may be deposited by thin film techniques, in which case it may be important that any high temperature firings needed to cure the dielectric layer 36 have already been performed.

If desired, a strip of metal 37 may be applied around the perimeter of the LIMMS device. Such a strip 37 is part of an hermetic seal with a cover plate 38 and is formed of solder or glass frit. The hermetic seal may also involve there being a beveled edge 39 along the perimeter of the cover plate 38. Cover plate 38 is preferably of ceramic, although one could use glass, as well. On the underside of the cover plate is applied a patterned layer 40 of adhesive, such as CYTOP. The patterning of the adhesive layer 40 matches that of the dielectric layer 36 that it is to mate against, and is shown by the dotted lines. Also shown as dotted lines are metalized regions 47, 48 and 49 that correspond to the regions 41–43 formed in the channel 46. Metalized regions 47–49 offer additional surface for wetting at the various locations of the liquid metal, and may also be deposited by thin film techniques.

To assemble the LIMMS shown in view 25 of FIG. 5, the channel 46 would receive its droplets of liquid metal (not shown) and, while in an atmosphere of a suitable gas, such as $N_2$, the cover plate 38 would be affixed against the substrate 26 bearing the patterned layer 36 of dielectric material. Then the hermetic seal would be formed.

We are always interested in techniques that improve device capability, reduce device fabrication cost, reduce the costs associated with connecting the device to a surrounding circuit, reduce device power consumption or increase the reliability of the device and its various interconnections with other circuitry. The speed of operation and power consumption of a LIMMS device would be favorably affected if more of the operating gas were in contact with the heater resistor and if less of the heater resistor's heat were captured by the substrate. Heater resistors that are affixed directly to traces or pads formed on the substrate are very close to the substrate, reducing the resistor area available to heat the gas and waste power by heating the substrate. Moreover, forming recesses in sheet of ceramic or glass is an onerous task, and one that may involve nasty chemicals that are not easily handled. Also, it may be that such forming requires process capabilities that not otherwise needed, so that if another existing process could be used instead, a certain simplification in manufacturing logistics is obtained. And there is the promise that if an existing process is re-used, the resulting structure will have thermal expansion characteristics that are quite compatible with the other structures. For these reasons, we should like to re-visit how the heaters are mounted, and perhaps get rid of the recesses dug into the cover block. The use on the bottom substrate of a patterned layer of dielectric forming cavities, channels and interconnecting passages is an attractive starting point. But then what?

SUMMARY OF THE INVENTION

An attractive solution to the problem of efficient fabrication of the channels and cavities in a LIMMS device is to form them as matching upper and lower portions each created as a patterned layer of thick film dielectric material deposited on a respective upper or lower substrate. The two portions are adhered together by a patterned layer of adhesive, and hermetically sealed around an outer perimeter. The heater resistors are mounted atop the lower layer, thus suspending them away from that substrate and exposing more of their surface area. Vias can be used to route the conductors for the heaters and the switched signal contacts through the lower substrate to cooperate with surface mount techniques using solder balls on an array of contact pads. Such vias are not normally hermetic, but can be made so by their placement within the patterned layers of dielectric material. If desired, the upper substrate and its patterned dielectric layer could be replaced by a conventional flat substrate that has had recesses formed therein.

This plan depends upon the use of a suitable dielectric material, which must be strong, adheres well to the substrate, is impervious to contaminants, is capable of being patterned, and if also desired, which can be metalized for soldering. It should also have well controlled and suitable properties as a dielectric. Given a choice, a lower dielectric constant (K) is preferable over a higher one. Suitable thick film dielectric materials that may be deposited as a paste and subsequently cured include the KQ 150 and KQ 115 thick film dielectrics from Heraeus and the 4141A/D thick film compositions from DuPont.

DESCRIPTION OF A PREFERRED EMBODIMENT

Figure 1A:
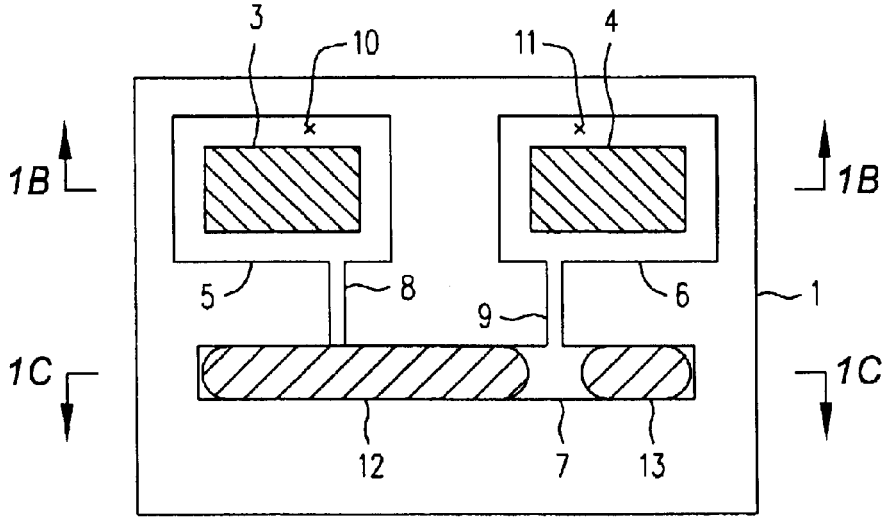
FIG. 1A PRIOR ART
FIGS. 1A–C are various sectional views of a prior art SPDT Liquid Metal Micro Switch (LIMMS), and wherein for convenience, while the heaters are shown as located on opposite ends of the channel, they are also shown as being on the same side thereof.
Figure 1B:
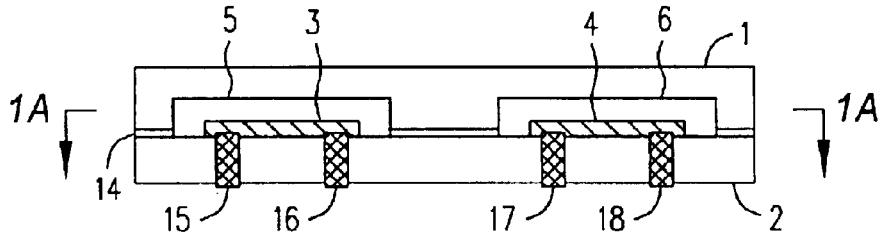
FIG. 1B PRIOR ART
Figure 1C:
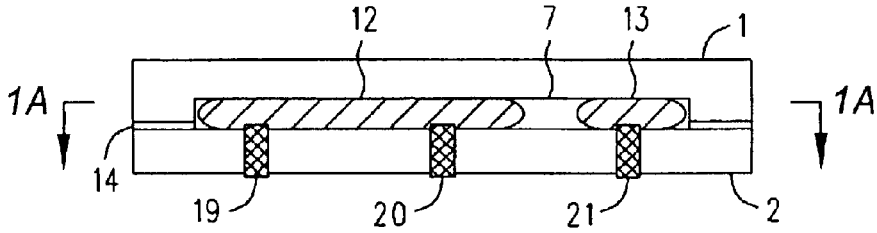
FIG. 1C PRIOR ART
Figure 2:
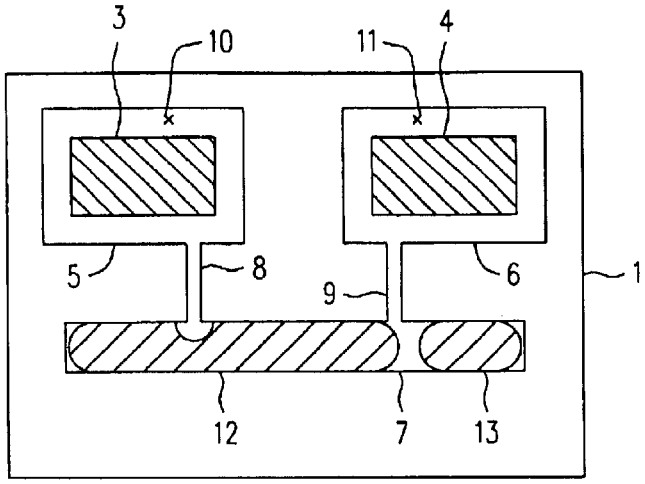
FIG. 2 PRIOR ART
FIG. 2 is a sectional view similar to that of FIG. 1A, at the start of an operational cycle.
Figure 3A:
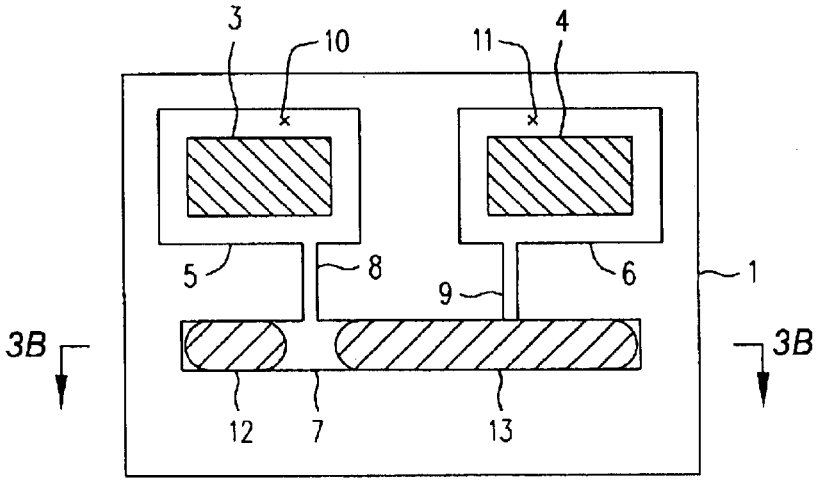
FIG. 3A PRIOR ART
FIGS. 3A–B are sectional views of the LIMMS of FIGS. 1A–C at the conclusion of the operation begun in FIG. 2.
Figure 3B:
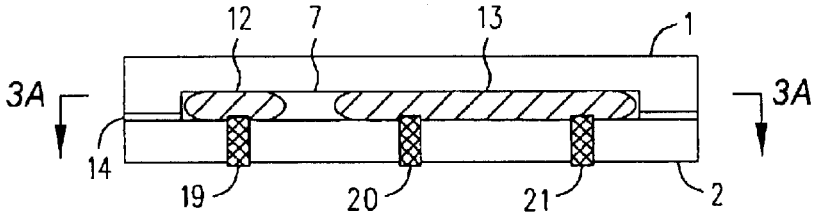
FIG. 3B PRIOR ART
Figure 4:
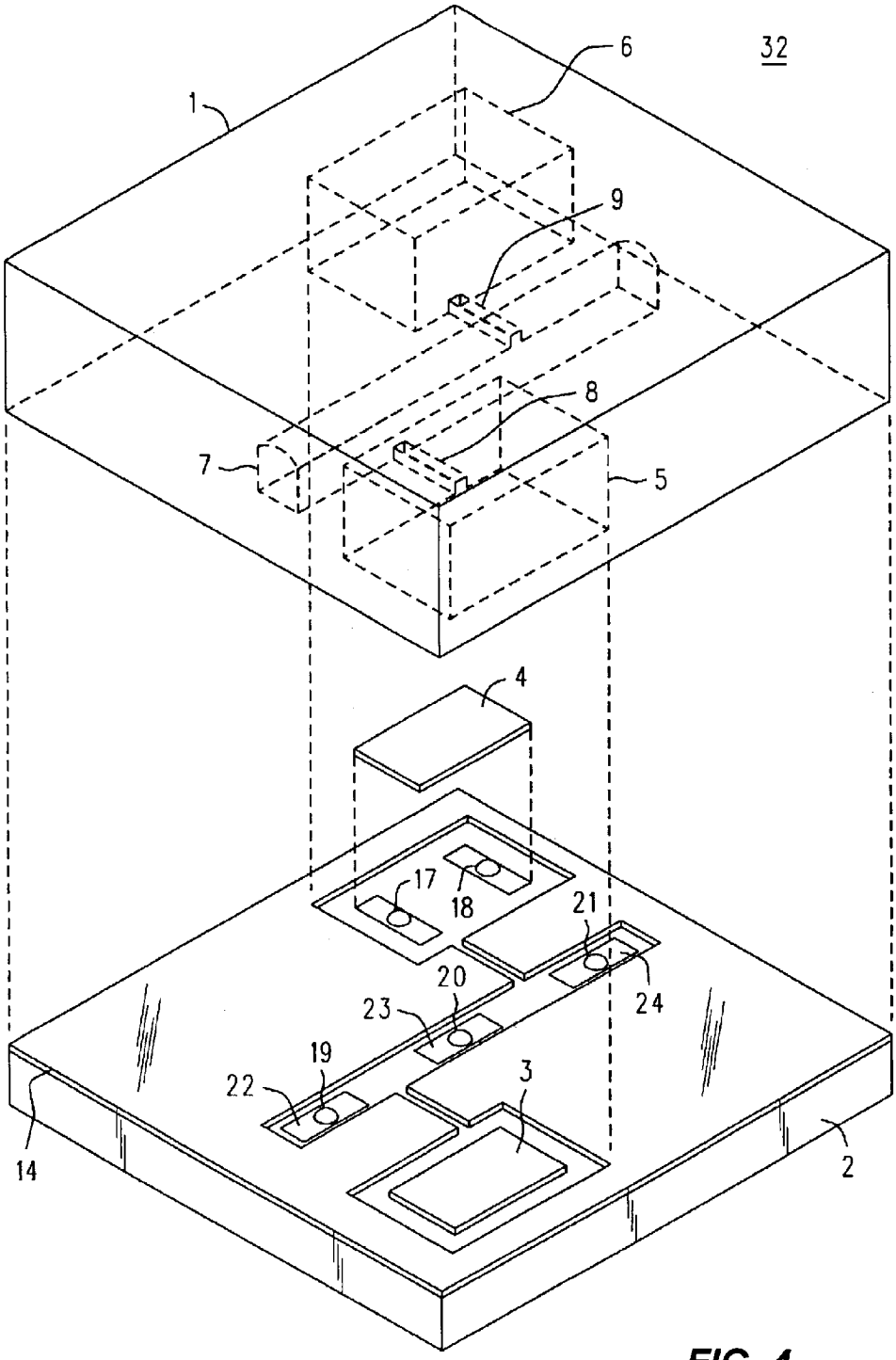
FIG. 4 PRIOR ART
FIG. 4 is an exploded view of a prior art SPDT LIMMS similar to what is shown in FIGS. 1–3, but where the heaters are disposed both on opposite sides and on opposite ends of the channel.
Figure 5:
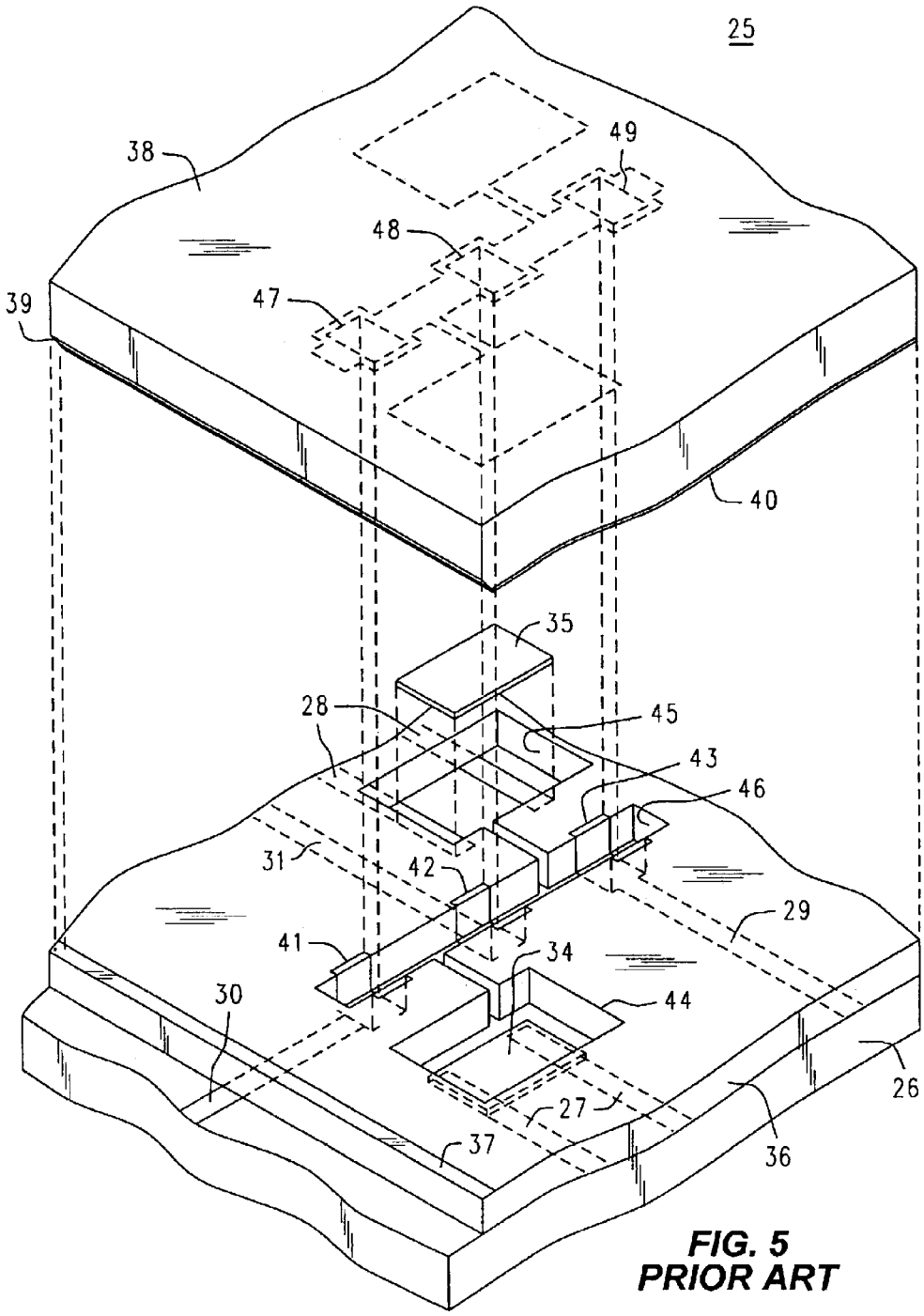
FIG. 5 PRIOR ART
FIG. 5 is a simplified exploded view of a prior art LIMMS device that is fabricated with a ceramic cover plate disposed atop a layer of patterned thick film dielectric.
Figure 6:
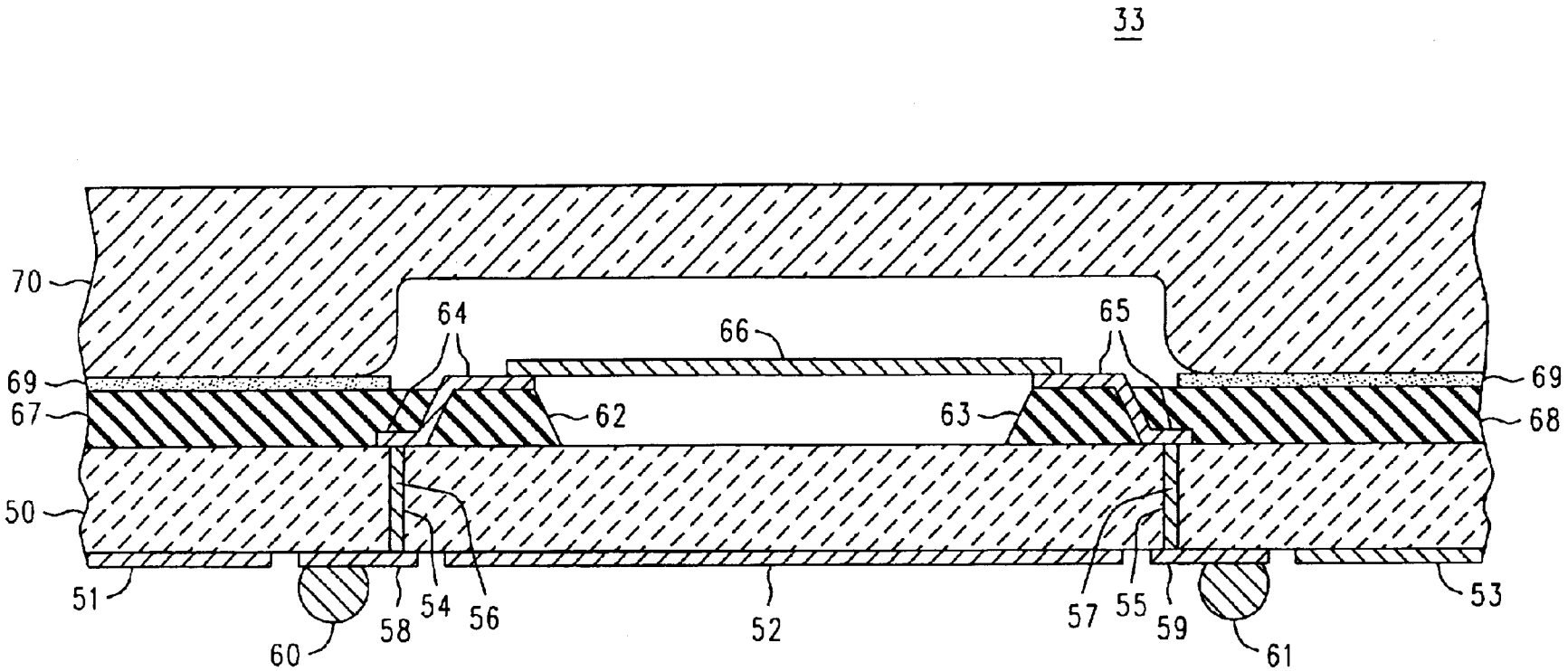
FIG. 6 is a simplified cross sectional view of a LIMMS device having a recessed cover block and sequentially applied multiple patterned layers of dielectric material that not only form a heater cavity but also serve to suspend the heater resistor away from a lower substrate, and which uses vias and ascending pads to bring the resistor's electrical connections out on the bottom surface of the lower substrate to allow surface mounting with an array of solder balls.

Refer now to FIG. 6, wherein is shown a simplified representation 33 of a cross section taken through a heater cavity for a LIMMS device constructed with the heater resistor therein 66 suspended above the substrate 50. The substrate 50 may be of ceramic or of glass, and it has had holes 54 and 55 drilled or otherwise formed therein to act as vias for the conductors that carry the electrical signals that drive the heater resistor 66. What is contemplated is the possibility of a larger arrangement (not itself depicted) wherein there may be carried by the substrate 50 many other LIMMS devices or other circuit elements (after the manner of complete circuit assemblies mounted on the substrate to form a so-called hybrid circuit) having, in total, a large number of conductors to be dealt with, so that it is desirable to use ball grid surface mount techniques to connect those conductors to the larger outer environment. On the other hand, we do not rule out the possibility that the number of conductors is still modest, or even small, but that it is nevertheless desirable for some other reasons to employ the surface mount ball grid technique. (These reasons might include, but are not limited to, the pre-existence in the manufacturing environment of a surface mount process for the larger part—the hybrid—being built, an absence or aversion to wire bonding in favor of the solder ball idea, and a possibility that the density of the hybrid is so high that it is desirable to minimize the amount of surface real estate devoted to interconnection between parts.) In any event, the reader will appreciate that the application of vias is an effective way to get signals from one side of a substrate to another, for whatever reason.

To continue, the underside of the substrate 50 has a patterned layer of metal, very possibly of gold, of which regions 51, 52, 53, 58 and 59 are representative. Elements 51–53 may be simply a ground plane or serve as portions of controlled impedance transmission line structures, such as co-planar transmission lines. Alternatively, one or more of 51–53 might be absent. Elements 58 and 59 are pads that connect to metallic plugs 56 and 57, respectively. Those plugs are formed in the holes 54 and 55 and serve as the actual electrical connection of the via from one side of substrate 50 to the other. Pads 58 and 59 carry solder balls 60 and 61 that are central to the surface mount ball grid technique: they re-flow against a matching pattern of mounting pads upon the application of heat during the process of attaching (by soldering) the part in FIG. 6 to a larger part (not shown) that carries it. It will be appreciated that there may be a layer of solder resist (not shown) that assists in avoiding unwanted connection between 51–53 and any conductive surface proximate after mounting.

And now to a topic of some interest. While the regions 51–53 might be the remnants of an undifferentiated sheet originally covering the entire bottom surface of the substrate 50 and patterned by etching, the subsequent manner of forming a plug/pad combination (54/58, 57/59) is as follows. First, the associated hole is drilled and the hole filled (plugged) with a powdered composition including the metal, such as gold. It is then made hard and permanent by the application of heat, as in sintering. There is some shrinkage of the plug as it is fired, both longitudinally along its axis and in diameter. The diameter shrinkage creates a non-hermetic seal, which is also compounded by the porosity of the plug.

After the plug is formed the bottom pad (58, 59) is printed using, for example, a powered thick film composition of PtPdAg, which is then fired. The plug and the pad make electrical contact owing to their intimate proximity. The PtPdAg is, after curing, an effective hermetic seal across the (bottom) end of the via. The PtPdAg pad is thin, and if soldered to in the immediate region of the via plug, permits leaching of the via plug's metal through the pad and into the solder. This can embrittle the solder, which causes reliability problems. This leads us to use an enlarged or elongated pad with the solder ball offset from the plug.

For additional hermetic protection we are inclined to also individually seal the top end of each via as it emerges from (or enters into) the substrate. And, we want to suspend the heater resistor 66 that is associated with these vias. Mindful that processing steps cost money, we would appreciate it if there were a way to accomplish two goals by combing steps common to both goals.

After having formed the vias and their pads 58 and 59, we apply regions 62 and 63 of patterned thick film dielectric material. That application is a printing and firing step involving, for example, either the (afore-mentioned in the Summary) KQ material from Heraeus or the DuPont product. (Note the sloped sides of the regions 62 and 63; they arise as explained the Background during the firing that cures the multiple printed layers of the dielectric material.) Then we print and fire gold or silver bearing pads 64 and 65 from the vias to top surfaces of regions 62 and 63, respectively. They are in turn covered by any protective metallic layer (chromium or molybdenum) needed to protect against mercury or mercury vapor. These pads are hermetic. The sloping sides leading down toward the vias are useful at this point, as printing on a slope is quite possible, while printing along a vertical portion of a steep transition is problematic. Next, regions of dielectric 67 and 68 are formed, proceeding right up the sloping portion of the pads 64 and 65, respectively. Notice that the entire top of the vias are enclosed by the dielectric material. It is a glass-like substance after it is cured, and quite suitable as an hermetic seal. The result is a good hermetic seal in a pad that is impervious to attack from the mercury, and whose surface well above the substrate (for affixing a suspended heater resistor 66).

Subsequently, heater resistor 66 is affixed in place. Suitable resistors include known semiconductor composites as well as other known materials, and there are various known ways of electrically and physically attaching them to the pads (64, 65). In due course a cover plate 70 (which may be of glass, or perhaps ceramic) having suitable recesses (for the heater cavities and perhaps the liquid metal channels and their interconnecting passages) and bearing a matching pattern of CYTOP is attached. One way to form the patterning of the cover plate and the layer of CYTOP is to apply a layer of the CYTOP to the underside of the cover plate and then use an abrasive blasting process to pattern both at the same time. Known techniques may be used to accomplish an additional hermetic seal between the perimeter of the cover plate 70 and the substrate 50.

Figure 7:
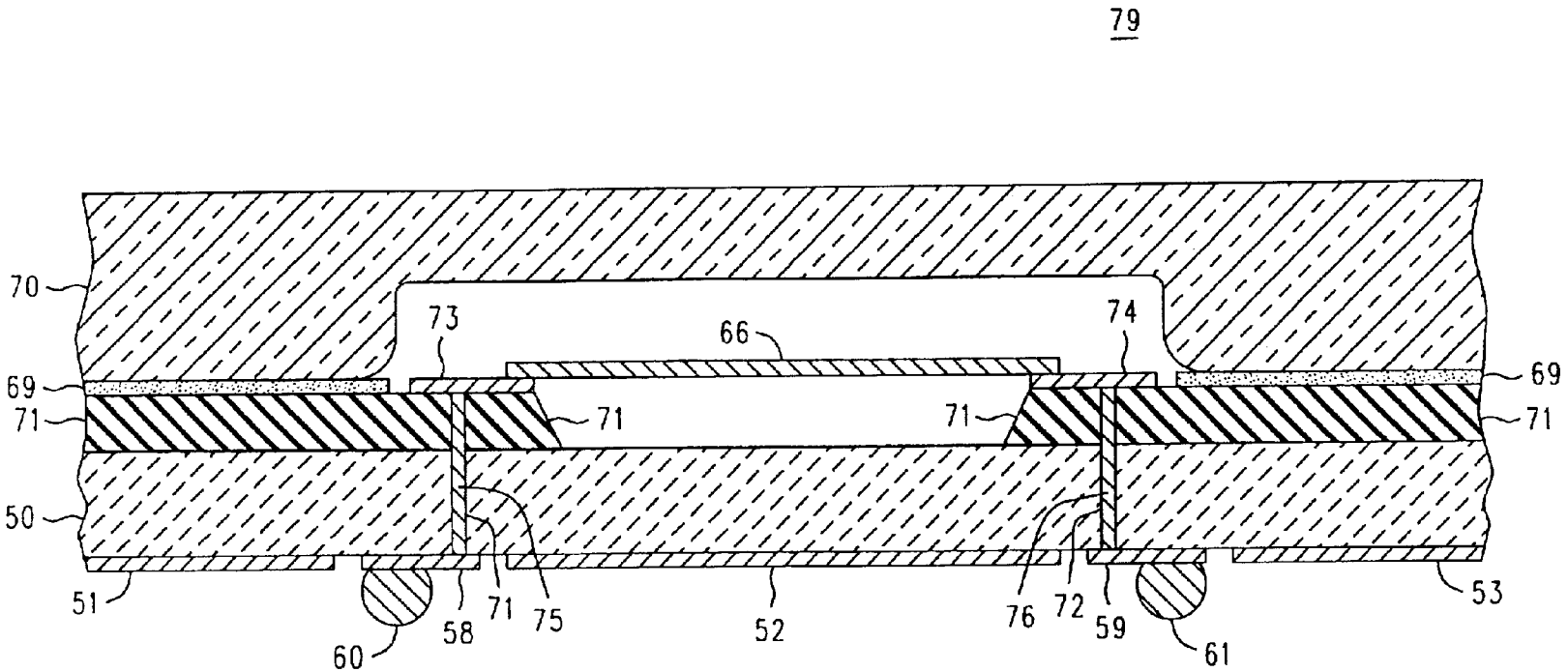
FIG. 7 is a simplified cross sectional view of a LIMMS device having a recessed cover block and a patterned layer of dielectric material that not only forms a heater cavity but also serves to suspend the heater resistor away from a lower substrate, and which uses unitary vias to bring the resistor's electrical connections through the combined dielectric layer and substrate out onto the bottom surface of the lower substrate to allow surface mounting with an array of solder balls.

Refer now to FIG. 7, wherein is shown a cross section 79 similar to that 33 of FIG. 6, save that the vias and the layer of dielectric material are formed in a somewhat different manner. The difference is that a single patterned layer 71 of dielectric material is formed before the holes 71 and 72 are drilled for the vias. When those holes are drilled they made are all the way straight through both the substrate 50 and the layer of dielectric 71. We next form long via plugs 75 and 76. Then offset bottom pads 58 and 59 are formed, as are top pads 73 and 74. In all other aspects FIGS. 6 and 7 are essentially the same.

We now use FIG. 7 as a point of departure for a further improvement. We would like to dispense with a top cover plate 70 having recessed cavities and/or channels therein. How that may be accomplished is shown and discussed in connection with FIGS. 8 and 9.

Figure 8:
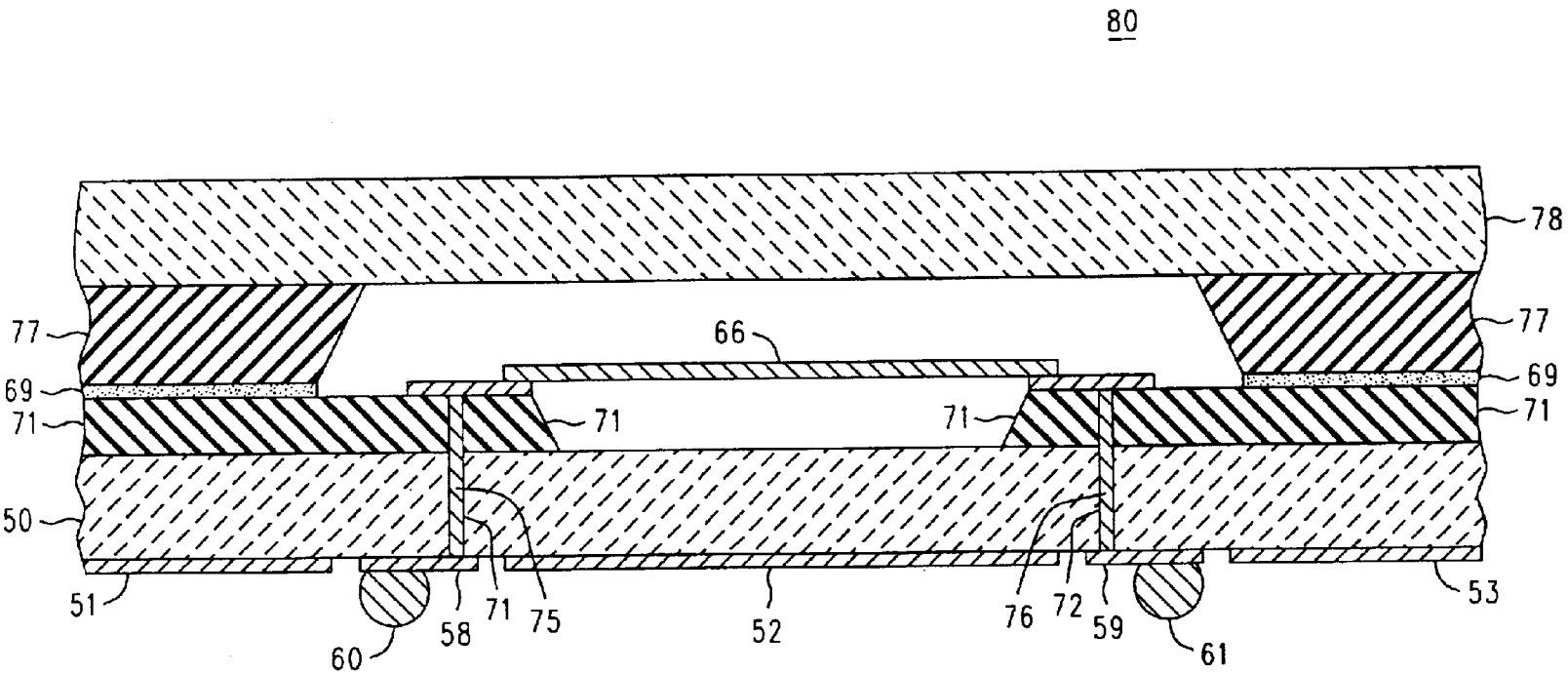
FIG. 8 is a simplified cross sectional view similar to that of FIG. 7, except that the recessed cover block is replaced by an upper substrate having channels and cavities formed in a patterned layer of dielectric material.

Referring now to FIG. 8, shown therein is a cross sectional view 80 whose lower portion (from adhesive layer 69 and resistor 66 downward) is the same as in FIG. 7, but which does not incorporate the recessed top cover plate 70. In its place there is a top substrate 78 bearing a patterned layer 77 of dielectric material, that may be either the KQ material from Heraeus or the DuPont product. The patterning of dielectric layer 77 matches whatever recesses, channels, passages and cavities that would have been in the cover plate 70, had it been used instead. The upper substrate and its patterned dielectric layer 77 are attached by the patterned adhesive layer 69, as before. It will, of course, be appreciated that technique of FIG. 8 (the forming of recesses, channels, passages and cavities in a dielectric layer patterned on an upper substrate) could also be used with the technique of FIG. 6 to replace the cover plate 70.

Figure 9:
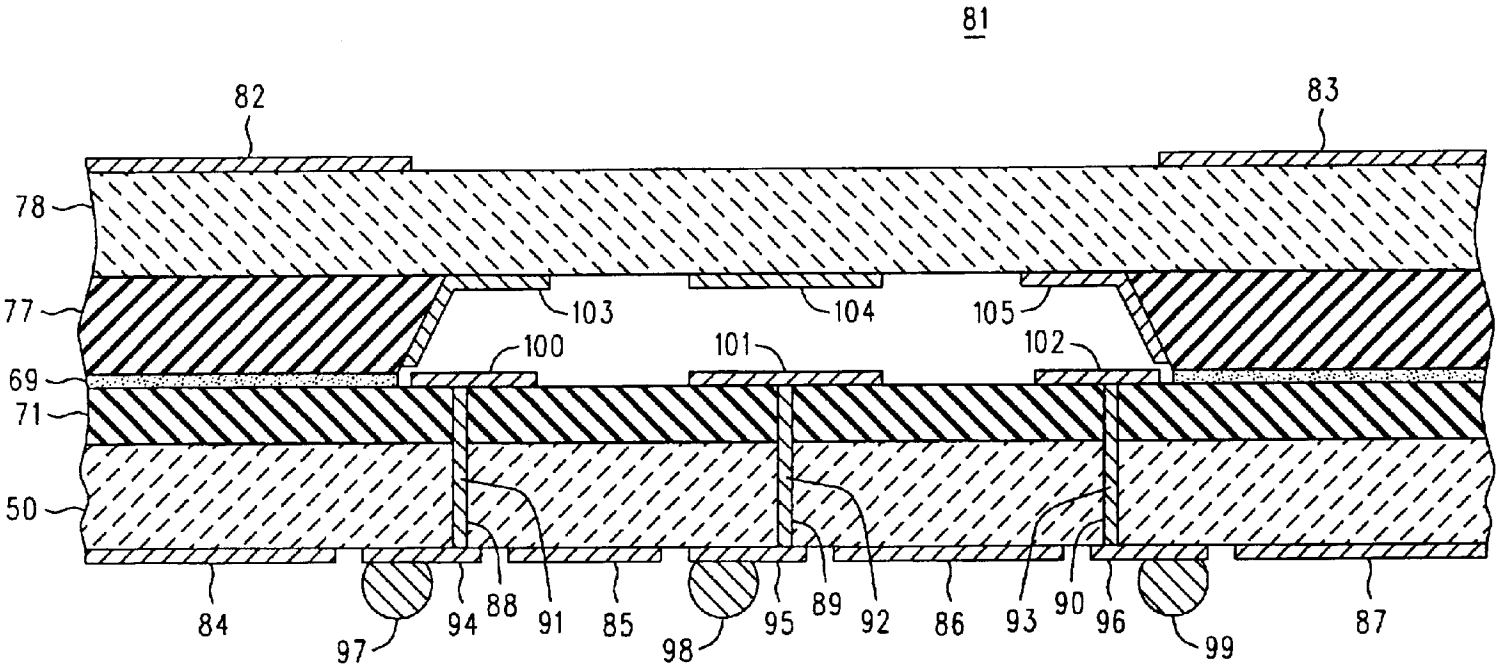
FIG. 9 is a simplified cross sectional view similar to that of FIG. 8, except that it is for a region of the LIMMS device having a liquid metal channel.

Finally, refer now to FIG. 9, which is a cross sectional view 81 of LIMMS device fabricated in the manner of FIG. 8, but where the sectional view is taken through channel containing the movable liquid metal droplet (or slug). It will be appreciated, then, that in this view substrate 50 has the deposited and then patterned layer 71 of dielectric (which includes a void under the heater resistor 66 of FIG. 8, but does not have such a void as part of the heater channel shown in FIG. 9, although it might). The underside of substrate 50 may have patterned metallic regions 83–87 that correspond to 51–53 of FIG. 8. In the same way, the three vias in FIG. 9 are formed with holes 88–90 that contain plugs 91–93, and that are respectively in ohmic contact with pads 94–97, and also respectively with pads 100–102. Solder balls 97–99 are offset from their respective plugs 91–93. Upper substrate 78 may optionally have the patterned remnants 82 and 83 of metal that serve either as a ground shield, ground plane or as signal conductors.

Now note metallic regions 103–105. These are depositions that are intended to provide a wetting action to the movable metallic droplet, as mentioned earlier. They are not there to provide electrical contact, so that we have for that, for instance, region 103 does not touch pad 100. It does not touch because region 103 does not extend over the lip of layer 77 toward the region occupied by the layer 69 of CYTOP. Now, it likely would not hurt anything if region 103 did extent to the left and was covered by the CYTOP: the CYTOP is resilient and the layer of metal forming region 103 is thin.

Recall that if the moving metal is mercury and the pads 100–102 and their associated regions 103–105 are of gold (or another metal that reacts with mercury), then those surfaces of gold must be protected from amalgamation and being dissolved by covering layers of suitable protection, say, of chromium or molybdenum.

We claim:

1. An electrical switching assembly comprising:

a first non-conductive substrate having first and second surfaces;

a first layer of dielectric material deposited upon the first surface of the first non-conductive substrate and patterned to create heater cavities, a liquid metal channel and passages connecting the heater cavities to locations along the liquid metal channel;

a second non-conductive substrate having a first surface;

a second layer of dielectric material deposited upon the first surface of the second non-conductive substrate and patterned to match at least the heater cavities of the first layer of dielectric material;

a layer of adhesive deposited on the second layer of dielectric material and patterned to match the pattern of the first layer of dielectric material; and the surfaces of first and second non-conducting substrates facing each other and being brought into contact through the intervening first and second layers of dielectric material and the layer of adhesive.

2. An electrical switching assembly as in claim 1 wherein at least one of the first and second non-conductive substrates is of glass.

3. An electrical switching assembly as in claim 1 wherein at least one of the first and second non-conductive substrates is of ceramic.

4. An electrical switching assembly as in claim 1 further comprising conductive vias through the first non-conductive substrate and first layer of dielectric material, an end of each conductive via being within the heater cavity.

5. An electrical switching assembly as in claim 4 further comprising pads inside the heater cavity that cover the vias and a heater resistor suspended between the pads.

6. An electrical switching assembly as in claim 4 further comprising conductive vias through the first non-conductive substrate and first layer of dielectric material, an end of each conductive via being within the liquid metal channel.

7. An electrical switching assembly as in claim 1 wherein the first and second layers of dielectric material are deposited with thick film techniques.

8. An electrical switching assembly comprising:

a first non-conductive substrate having first and second surfaces;

a layer of dielectric material deposited upon the first surface of the first non-conductive substrate and patterned to create heater cavities, a liquid metal channel and passages connecting the heater cavities to locations along the liquid metal channel;

a second non-conductive substrate having a first surface patterned to match at least the heater cavities of the first layer of dielectric material;

a layer of adhesive deposited on the first surface of the second non-conductive substrate and patterned to match the pattern of the layer of dielectric material; and the surfaces of first and second non-conducting substrates facing each other and being brought into contact through the intervening layer of dielectric material and the layer of adhesive.

9. An electrical switching assembly as in claim 8 wherein at least one of the first and second non-conductive substrates is of glass.

10. An electrical switching assembly as in claim 8 wherein at least one of the first and second non-conductive substrates is of ceramic.

11. An electrical switching assembly as in claim 8 further comprising conductive vias through the first non-conductive substrate and first layer of dielectric material, an end of each conductive via being within the heater cavity.

12. An electrical switching assembly as in claim 11 further comprising pads inside the heater cavity that cover the vias and a heater resistor suspended between the pads.

13. An electrical switching assembly as in claim 11 further comprising conductive vias through the first non-conductive substrate and first layer of dielectric material, an end of each conductive via being within the liquid metal channel.

14. An electrical switching assembly as in claim 8 wherein the first and second layers of dielectric material are deposited with thick film techniques.

* * * * *

UNITED STATES PATENT AND TRADEMARK OFFICE

CERTIFICATE OF CORRECTION

PATENT NO. : 6,777,630 B1
DATED : August 17, 2004
INVENTOR(S) : Lewis R. Dove et al.

It is certified that error appears in the above-identified patent and that said Letters Patent is hereby corrected as shown below:

Title page,
Item [57], ABSTRACT,
Line 18, after "from" delete "Heracus" and therefor insert -- Heraeus --

Signed and Sealed this

Second Day of August, 2005

JON W. DUDAS
*Director of the United States Patent and Trademark Office*